United States Patent [19]

Silverstein

[11] 4,259,807

[45] Apr. 7, 1981

[54] DOLL WHICH GROWS

[76] Inventor: Marcia Silverstein, 64-34 Cloverdale Blvd., Bayside, N.Y. 11364

[21] Appl. No.: 971,047

[22] Filed: Dec. 19, 1978

[51] Int. Cl.[3] ..... A63H 3/20

[52] U.S. Cl. ..... 46/161; 46/DIG. 1; 46/163

[58] Field of Search ..... 46/135 R, 151, 152, 46/157, 158, 159, 160, 161, 162, 163, 173, DIG. 1, 119, 120

[56] References Cited

U.S. PATENT DOCUMENTS

| | | | |
|---|---|---|---|
| 268,020 | 11/1882 | Howard | 46/151 |
| 1,828,765 | 10/1931 | Crist | 46/159 |
| 3,316,669 | 5/1967 | Nachbar | 46/157 |
| 3,800,436 | 4/1974 | Matzek | 46/173 X |
| 4,094,093 | 6/1978 | Kaelin | 46/DIG. 1 X |

FOREIGN PATENT DOCUMENTS

| | | | |
|---|---|---|---|
| 228275 | 11/1910 | Fed. Rep. of Germany | 46/161 |
| 566160 | 9/1975 | Switzerland | 46/DIG. 1 X |
| 104280 | 3/1917 | United Kingdom | 46/135 R |

*Primary Examiner*—Gene Mancene
*Assistant Examiner*—Mickey Yu
*Attorney, Agent, or Firm*—Richard L. Miller

[57] ABSTRACT

A fabric-sewn doll, stuffed with polyester stuffing, and including the head and trunk being made in one piece while the arms and legs are separate pieces adjustably attached thereto, so that the size of the doll may be adjusted to be the same height as a growing child and thus be abe to share wearing the clothing of the child who owns it.

2 Claims, 5 Drawing Figures

DOLL WHICH GROWS

BACKGROUND OF THE INVENTION

This invention relates generally to dolls, such as are owned by children.

Heretofore children's dolls have been made generally of a size that is smaller than a child who plays with it, and the child usually pretends to be the big mother of the little doll by taking care of its needs.

However, there has not yet been made a doll for a child that can be regarded as a companion, a friend, or a brother or sister for the child, by being of the same size as its owner.

SUMMARY OF THE INVENTION

Accordingly it is the principal object of the present invention to provide a doll that can be made and which can be adjusted in height and size to a growing child.

Another object is to provide a doll that accordingly can share wearing the same clothing as the child, thus giving pleasure to the child dressing it in various different ensembles.

Another object is to provide a doll which as it is adjusted in length gives awareness to the child of its own growth.

Still another object is to provide a doll that can be quickly and easily adjusted as wished.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

PREFERRED EMBODIMENT OF THE INVENTION

Figure 1:
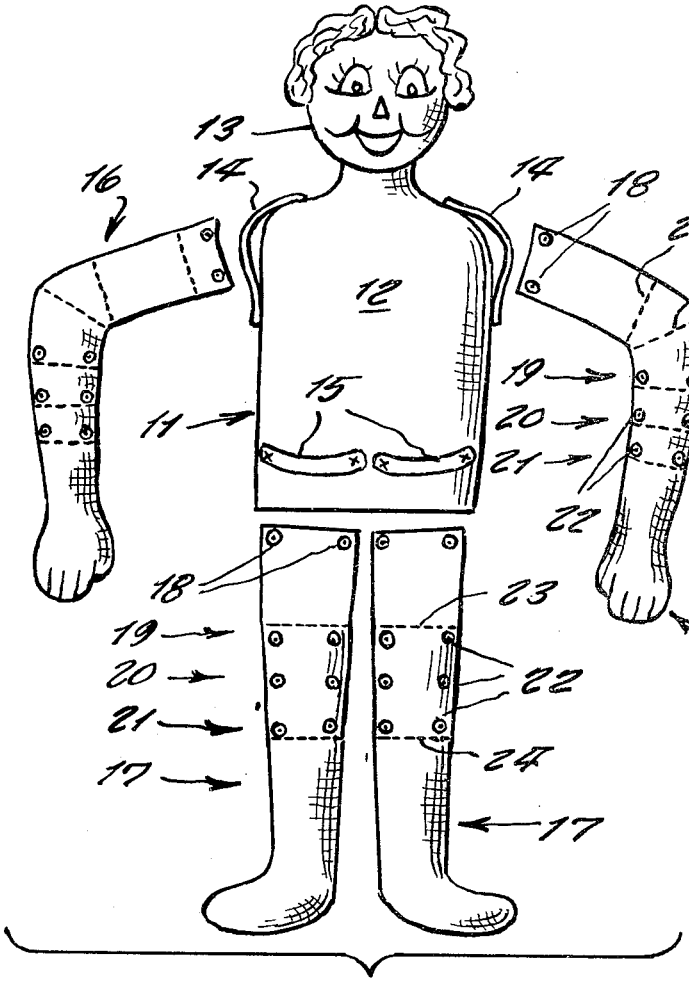
FIG. 1 is a front view of the doll shown with components disassembled.

Referring now to the drawings in greater detail, the reference numeral 10 represents a doll according to the present invention wherein the same is manufactured in seperate parts that are adjustably fastened together.

The doll includes a main part or trunk 11 that is comprised of a torso 12 and head 13. It is made of a fabric bag that is stuffed with a wadding of cotton or the like.

The outer surface of the fabric may be coloured so to imitate a flesh tone, and the facial features of the eyes, nose, and mouth may be painted on the head.

A pair of fabric loops 14 are stitched at the shoulders of trunk, and another pair of loops 15 are stitched along an underside or lower portion of the trunk, as shown.

A pair of arms 16 are attachable to the loops 14, and a pair of legs 17 are attachable to the loops 15.

Figure 2:
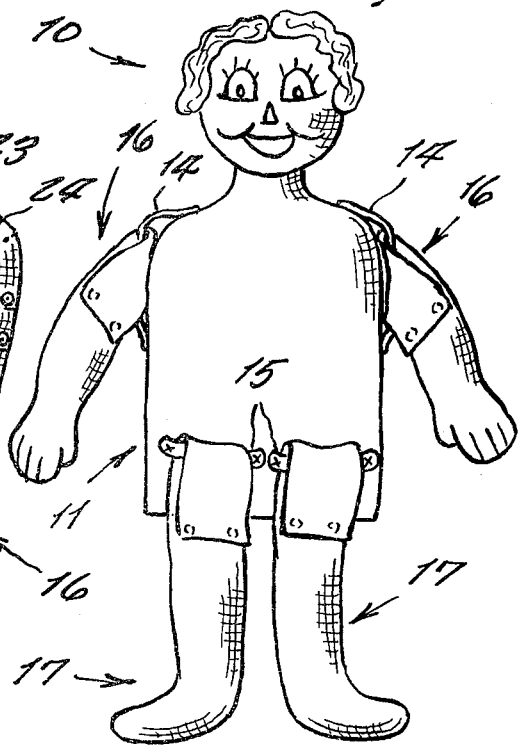
FIG. 2 is a similar view with components assembled for a specific doll size.
Figure 3:
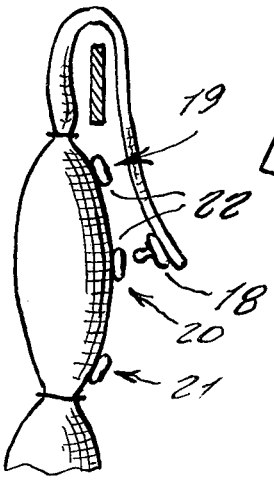
FIG. 3 is a fragmentary detail view partly in cross-section showing the size adjustment means, using snap fasteners.

The arms are likewise made of a flesh tinted fabric bag stuffed with cotton wadding. A pair of snap fasteners elements 18 are secured to the upper end of the arms, and which are selectively engagable with either row 19, 20, or 21 or mating snap fasteners elements 22, after the upper end of the arm is inserted through the loop 14, as shown in FIGS. 2 and 3. Thus the arm's length is relatively adjustable.

In order that the arm may easily fold around the loop, the upper portion of the arm may be left unstuffed as shown. Stitching 23 across the arm serves to divide the stuffed and unstuffed interior compartments of the arm. Another cross stitching 24 provides arm flexibility such as at the elbow.

The legs are likewise made of fabric, and are stuffed in lower portions thereof, while upper ends are made foldable so as to fit around the loops 15. Similar snap fasteners elements 18 engage elements 22 in either selected rows 19, 20, or 21 in order to form either shorter or longer legs, as wished.

Cross stitching 23 divides stuffed and unstuffed portions, and cross stitching 24 allows knee bending.

In a modified construction, the use of Velcro elements 25 and 26 may be utilized instead of the snap fasteners, thus allowing a more fine size adjustment instead of only three settings.

Figure 4:
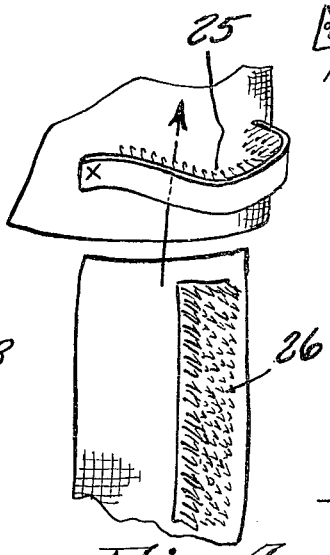
FIG. 4 is a detail showing use of Velcro for size adjustment.
Figure 5:
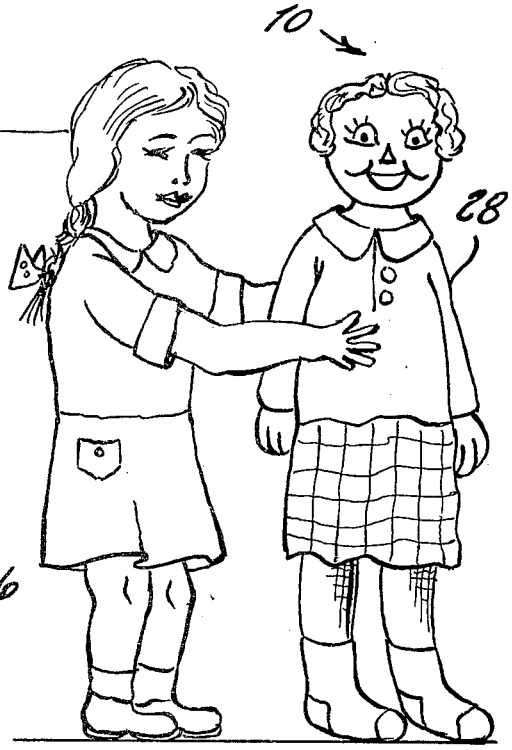
FIG. 5 shows a child with the doll adjusted to the same height as the child and wearing the child's clothes.

One Velcro element 25 is on the inner side of the loops 14 and 15 and the other element 26 is on the arms or legs, extending longitudinally as shown in FIG. 4, to form a long strip.

It is now apparent that the doll can be easily adjusted in height and arm length, so as to be of the same size as a growing child 27 in order that the child can dress up the doll with the child's own clothing 28.

The loops 14 and 15 may be made to the same size so that the arms and legs may be interchangeable in location, just for fun, if so desired.

In a practical construction, the doll may be manufactured 32 inches tall when legs are at shortest height, so as to correspond to a child of one to two years old.

The name of the doll is "ROSE WHO GROWS."

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A doll, comprising in combination, a main body member or trunk, and a pair of arms and a pair of legs which are attachable adjustably in length to said trunk, wherein said trunk includes a pair of loops at the shoulder portions thereof, and a pair of loops at a lower portion thereof, so that said arms and legs are insertable therethrough, wherein base ends of said arms and legs are made foldable around said loops, wherein a plurality of rows of snap fastener elements are located along said arms and legs for selectively engaging a cooperative snap fastener element at an end of said arms and legs.

2. The combination as set forth in claim 1, wherein said loops further include one type of Velcro element on an inner side; and said snap fastener is a second type of Velcro element, being selectively engagable along any length portion thereof with said one type of Velcro element.

* * * * *